US010557258B2

(12) United States Patent
Tsuruta et al.

(10) Patent No.: US 10,557,258 B2
(45) Date of Patent: Feb. 11, 2020

(54) SANITARY WASHING DEVICE

(71) Applicant: AISIN SEIKI KABUSHIKI KAISHA, Kariya-shi (JP)

(72) Inventors: Yoshihisa Tsuruta, Anjo (JP); Takehiro Shimoyama, Anjo (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 49 days.

(21) Appl. No.: 15/887,306

(22) Filed: Feb. 2, 2018

(65) Prior Publication Data

US 2018/0223519 A1 Aug. 9, 2018

(30) Foreign Application Priority Data

Feb. 6, 2017 (JP) ..... 2017-019166

(51) Int. Cl.
*E03D 9/08* (2006.01)
*E03D 9/00* (2006.01)
*A47K 13/30* (2006.01)

(52) U.S. Cl.
CPC ..... *E03D 9/08* (2013.01); *A47K 13/30* (2013.01); *E03D 9/002* (2013.01)

(58) Field of Classification Search
CPC ..... E03D 9/08; B05B 15/20; B05B 15/555
USPC ..... 4/420.1–420.5, 443–448, 222–233
See application file for complete search history.

(56) References Cited

U.S. PATENT DOCUMENTS 8,701,222 B2 * 4/2014 Shin ..... E03D 9/08 4/420.4

FOREIGN PATENT DOCUMENTS

| | | | |
|---|---|---|---|
| CN | 2307843 Y | * | 2/1999 |
| JP | 2005-336856 | | 12/2005 |
| JP | 2015-161161 | | 9/2015 |

OTHER PUBLICATIONS

English Machine translation of CN 2307843 Y dated May 30, 2019 (Year: 1999).*

* cited by examiner

*Primary Examiner* — Christine J Skubinna
(74) *Attorney, Agent, or Firm* — Oblon, McClelland, Maier & Neustadt, L.L.P.

(57) ABSTRACT

A sanitary washing device includes: a nozzle that injects a liquid so as to wash a local region of a human body; a nozzle washing unit that washes the nozzle with the liquid; a supply flow path that connects a supply source of the liquid and the nozzle; a branch flow path that connects the supply flow path and the nozzle washing unit; a vacuum breaker that is disposed in a flow path that connects the supply source and the nozzle washing unit, in the supply flow path and the branch flow path; and a tank that is disposed in the branch flow path between the vacuum breaker and the nozzle washing unit and accommodates therein a sterilizing agent, a sterilizing component of which is dissolved in the liquid passing through the tank.

4 Claims, 8 Drawing Sheets

SANITARY WASHING DEVICE

CROSS REFERENCE TO RELATED APPLICATIONS

This application is based on and claims priority under 35 U.S.C. § 119 to Japanese Patent Application 2017-019166, filed on Feb. 6, 2017, the entire contents of which are incorporated herein by reference.

TECHNICAL FIELD

This disclosure relates to a sanitary washing device.

BACKGROUND DISCUSSION

JP 2015-161161 A (Reference 1) discloses a sanitary washing device having a nozzle unit, which includes a washing nozzle (nozzle) that washes a human body by injecting wash water thereto, and a nozzle washer (nozzle washing unit) that washes the washing nozzle with wash water. In the middle of a flow path for supplying the wash water to the nozzle unit, the sanitary washing device includes a vacuum breaker capable of taking air into the flow path. Thus, in the sanitary washing device, it is possible to drain water from the flow path and the nozzle unit by taking air into the flow path.

However, in the sanitary washing device described above, there remains room for improvement in terms of enhancing the sterilizing effect of the washing nozzle by the nozzle washer.

Thus, a need exists for a sanitary washing device which is not susceptible to the drawback mentioned above.

SUMMARY

A sanitary washing device includes: a nozzle that injects a liquid so as to wash a local region of a human body; a nozzle washing unit that washes the nozzle with the liquid; a supply flow path that connects a supply source of the liquid and the nozzle; a branch flow path that connects the supply flow path and the nozzle washing unit; a vacuum breaker that is disposed in a flow path that connects the supply source and the nozzle washing unit, in the supply flow path and the branch flow path; and a tank that is disposed in the branch flow path between the vacuum breaker and the nozzle washing unit and accommodates therein a sterilizing agent, a sterilizing component of which is dissolved in the liquid passing through the tank. The vacuum breaker opens a flow path which is connected to a downstream side of the vacuum breaker to atmosphere when no liquid is introduced from a flow path which is connected to an upstream side of the vacuum breaker. In the tank, an outlet port, through which the liquid is discharged, is disposed in a vertically upward position compared to an inner bottom surface of the tank.

BRIEF DESCRIPTION OF THE DRAWINGS

The foregoing and additional features and characteristics of this disclosure will become more apparent from the following detailed description considered with the reference to the accompanying drawings, wherein:

FIGS. 5A and 5B are side cross-sectional views of a nozzle unit and a nozzle washing unit, in which FIG. 5A illustrates a state where a nozzle is disposed at a storage position and FIG. 5B illustrates a state where the nozzle is disposed at a protruding position;

DETAILED DESCRIPTION

Hereinafter, an embodiment of a sanitary washing device will be described with reference to the drawings.

Figure 1:
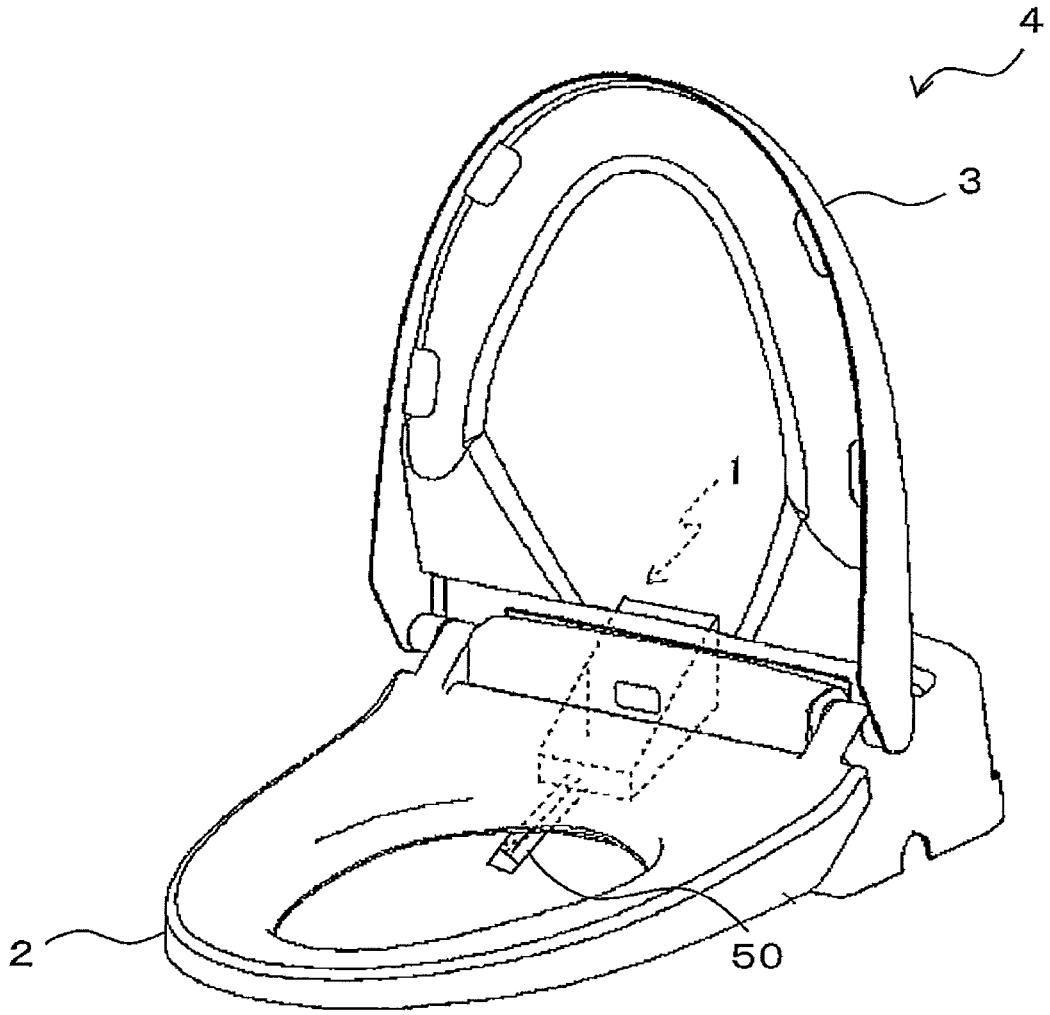
FIG. 1 is a perspective view illustrating a toilet seat having a sanitary washing device according to an embodiment.

As illustrated in FIG. 1, a toilet seat device 4 includes a toilet seat 2 on which a user sits, a toilet lid 3, which covers the toilet seat 2, and a sanitary washing device 1, which washes a local region of the user.

Figure 2:
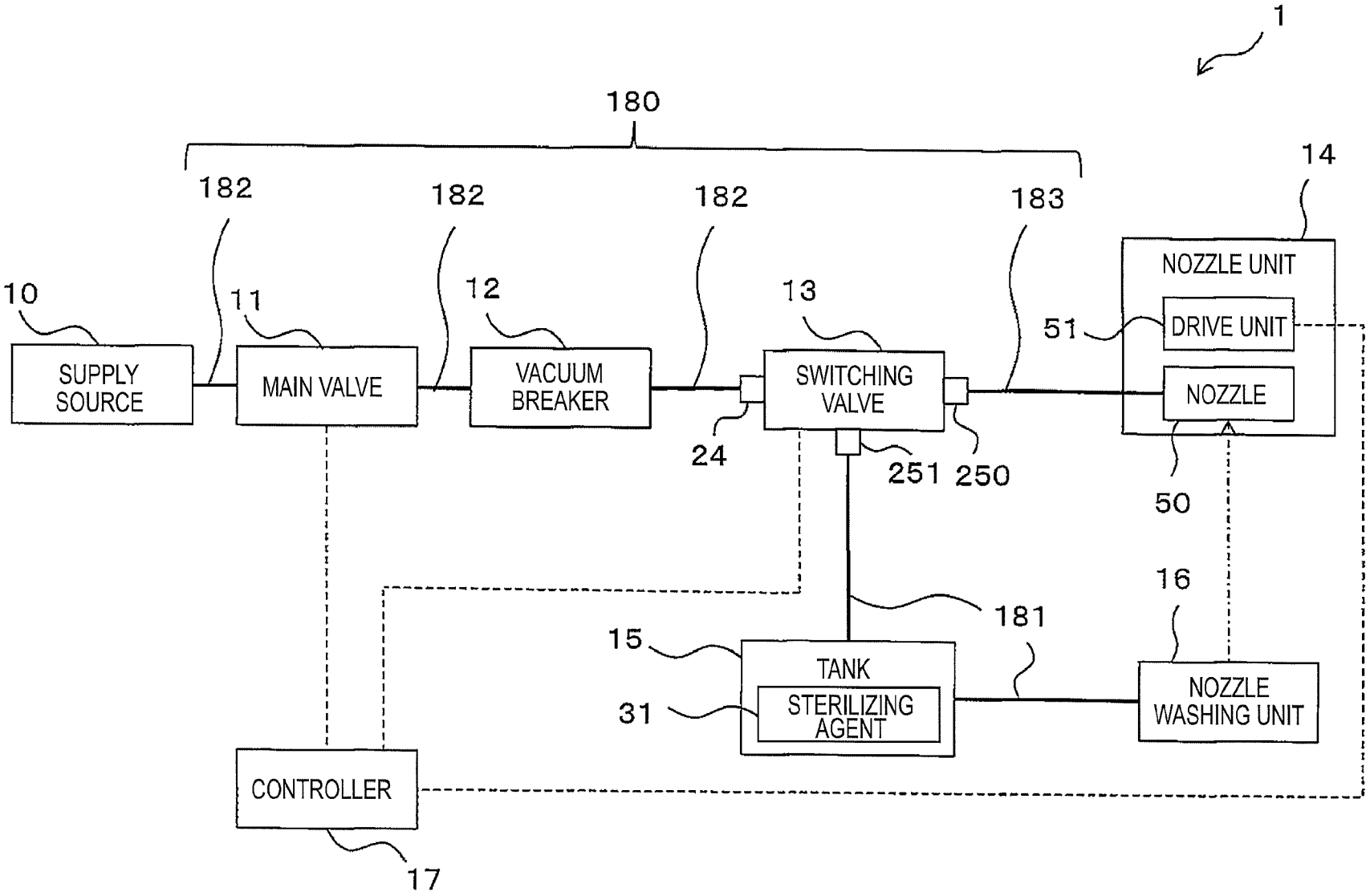
FIG. 2 is a view illustrating a configuration of the sanitary washing device.

As illustrated in FIG. 2, the sanitary washing device 1 includes a main valve 11, which switches the supply state of water supplied from a supply source 10, which supplies water (wash water) as an example of liquid, a vacuum breaker 12, which suppresses the generation of a vacuum state by introducing atmospheric air, a switching valve 13, which switches a water supply destination of water, a nozzle unit 14, which washes a local region of the human body by injecting water from a nozzle 50, a tank 15, which accommodates a sterilizing agent 31 therein, a nozzle washing unit 16, which washes the nozzle 50, and a controller 17, which controls the main valve 11, the switching valve 13, and the nozzle unit 14.

In addition, the sanitary washing device 1 includes a supply flow path 180, which connects the supply source 10 and the nozzle unit 14, and a branch flow path 181, which connects the supply flow path 180 and the nozzle washing unit 16. At this time, in the supply flow path 180, the portion from the supply source 10 to the connection portion with the branch flow path 181 will be referred to as a first supply flow path 182, and the portion from the connection portion to the nozzle unit 14 will be referred to as a second supply flow path 183.

As illustrated in FIG. 2, the supply source 10 is connected to the main valve 11 via the first supply flow path 182. The supply source 10 is, for example, a water service that supplies water to the main valve 11.

As illustrated in FIG. 2, the main valve 11 is electrically connected to the controller 17. The main valve 11 is a solenoid valve that is switched to an opened valve state or a closed valve state. The opened/closed state of the main valve 11 is switched by an input signal from the controller 17. The main valve 11 is provided between the supply source 10 and the vacuum breaker 12 in the first supply flow path 182.

In the opened valve state, the main valve 11 allows the supply of water from the supply source 10 to the vacuum breaker 12. In addition, in the closed valve state, the main valve 11 limits the supply of water from the supply source 10 to the vacuum breaker 12.

The vacuum breaker 12 suppresses backflow of water from the nozzle washing unit 16 and the nozzle 50 due to generation of a vacuum state inside the supply flow path 180.

Figure 3:
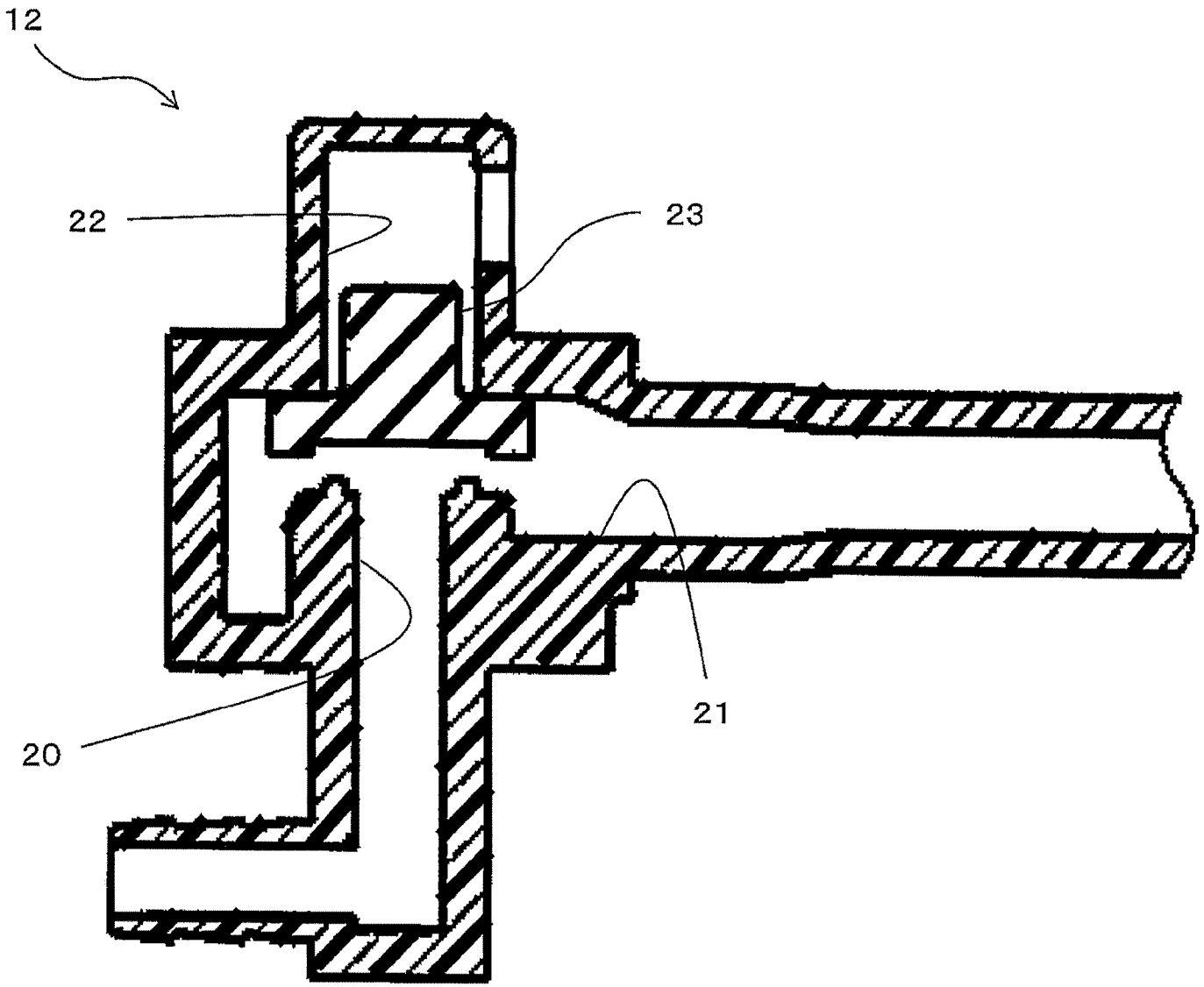
FIG. 3 is a side cross-sectional view of a vacuum breaker when water is fed.

As illustrated in FIG. 3, the vacuum breaker 12 includes an inlet flow path 20, an outlet flow path 21, an atmosphere communication port 22, and a valve body 23. The inlet flow path 20 is connected to the main valve 11 via the first supply flow path 182. The outlet flow path 21 is connected to the switching valve 13 via the first supply flow path 182. That is, the vacuum breaker 12 is provided on the upstream side of the switching valve 13 in the first supply flow path 182 of the supply flow path 180.

In addition, the atmosphere communication port 22 is open to the atmosphere. The valve body 23 switches the connection states between the inlet flow path 20 and the outlet flow path 21 and the atmosphere communication port 22.

As illustrated in FIG. 3, when the water supplied from the supply source 10 is supplied from the first supply flow path 182, which is connected to the upstream side of the vacuum breaker 12, to the inlet flow path 20, the valve body 23 is pushed up by the water introduced from the inlet flow path 20. Thus, the outlet flow path 21 is connected to the inlet flow path 20 and is not connected to the atmosphere communication port 22. Therefore, the water supplied from the supply source 10 is supplied to the switching valve 13.

Figure 4:
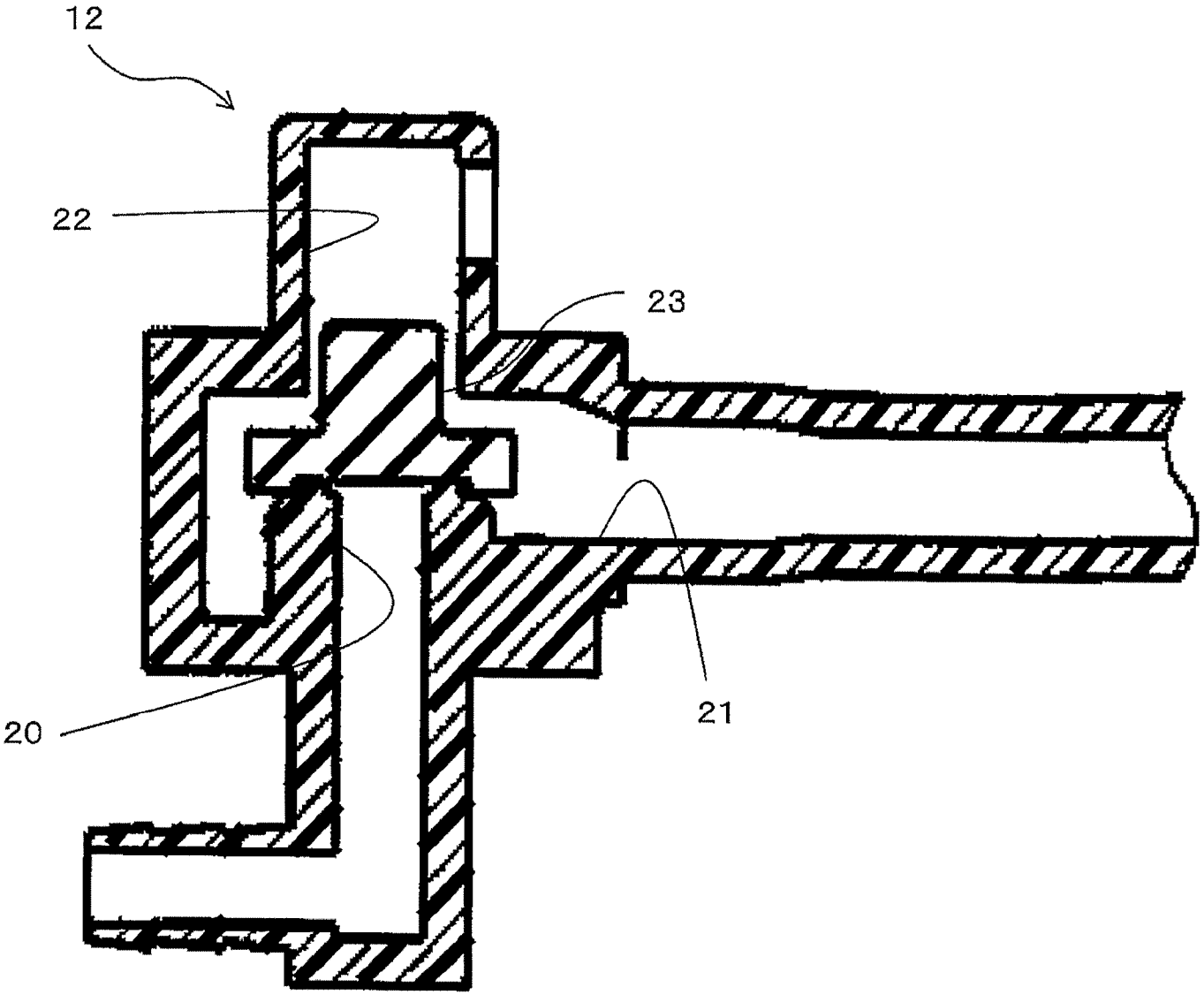
FIG. 4 is a side cross-sectional view of the vacuum breaker when water is not fed.

On the other hand, as illustrated in FIG. 4, when the water supplied from the supply source 10 is not supplied from the first supply flow path 182, which is connected to the upstream side of the vacuum breaker 12, to the inlet flow path 20, the valve body 23 is lowered by gravity. Thus, the outlet flow path 21 is connected to the atmosphere communication port 22 and is not connected to the inlet flow path 20. Therefore, the air is introduced from the atmosphere communication port 22 into the outlet flow path 21. That is, the vacuum breaker 12 opens the first supply flow path 182, which is connected to the downstream side of the vacuum breaker 12, to the atmosphere.

As illustrated in FIG. 2, the switching valve 13 is provided in the connection portion of the supply flow path 180 with the branch flow path 181. The switching valve 13 includes an inlet portion 24 connected to the outlet flow path 21 of the vacuum breaker 12 via the first supply flow path 182, a first outlet portion 250 connected to the nozzle unit 14 via the second supply flow path 183, and a second outlet portion 251 connected to the tank 15 via the branch flow path 181.

The switching valve 13 is electrically connected to the controller 17. The switching valve 13 is switched to any one of a state where the inlet portion 24 and the first outlet portion 250 communicate with each other, a state where the inlet portion 24 and the second outlet portion 251 communicate with each other, and a state where the inlet portion 24 does not communicate with any one of the first outlet portion 250 and the second outlet portion 251. The communication state of the switching valve 13 is switched by an input signal from the controller 17.

In other words, the switching valve 13 switches the connection state of the supply flow path 180 and the branch flow path 181. Specifically, the switching valve 13 switches the connection state to any one of: a state where the first supply flow path 182 and the second supply flow path 183 are connected to each other; a state where the first supply flow path 182 and the branch flow path 181 are connected to each other; and a state where the first supply flow path 182 is connected to none of the second supply flow path 183 and the branch flow path 181.

When the switching valve 13 is in a state where the inlet portion 24 and the first outlet portion 250 communicate with each other, the first outlet portion 250 discharges, to the nozzle unit 14, the water introduced from the inlet portion 24. In addition, when the switching valve 13 is in a state where the inlet portion 24 and the second outlet portion 251 communicate with each other, the second outlet portion 251 discharges, to the tank 15, the water introduced from the inlet portion 24. When the switching valve 13 is in a state where the inlet portion 24 communicates with none of the first outlet portion 250 and the second outlet portion 251, no movement of water occurs in the switching valve 13.

Figure 5A:
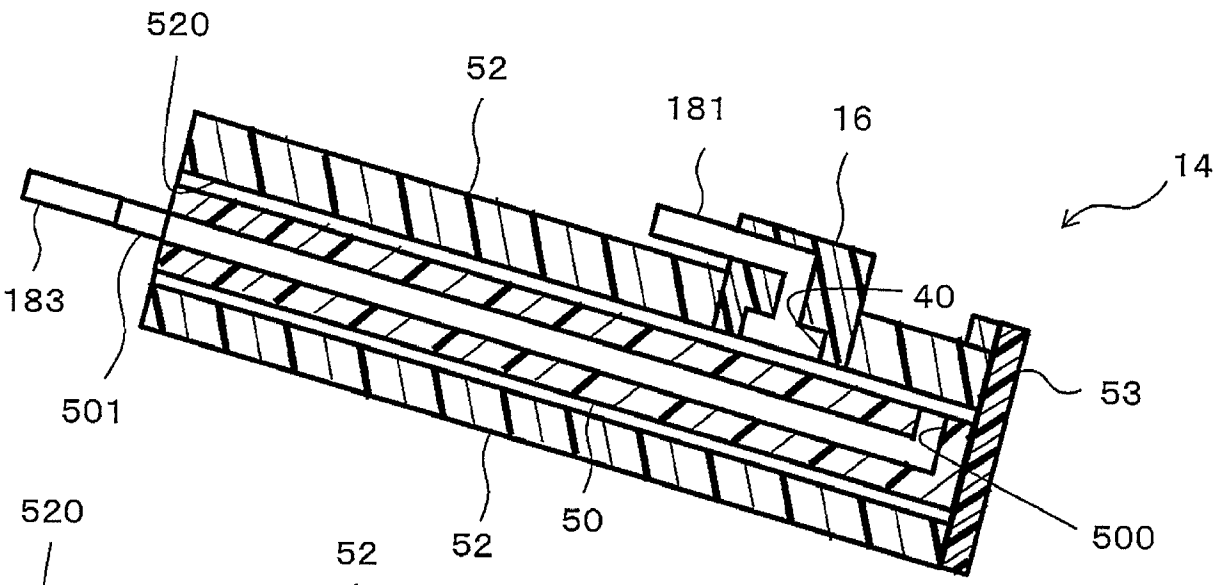
Figure 5B:
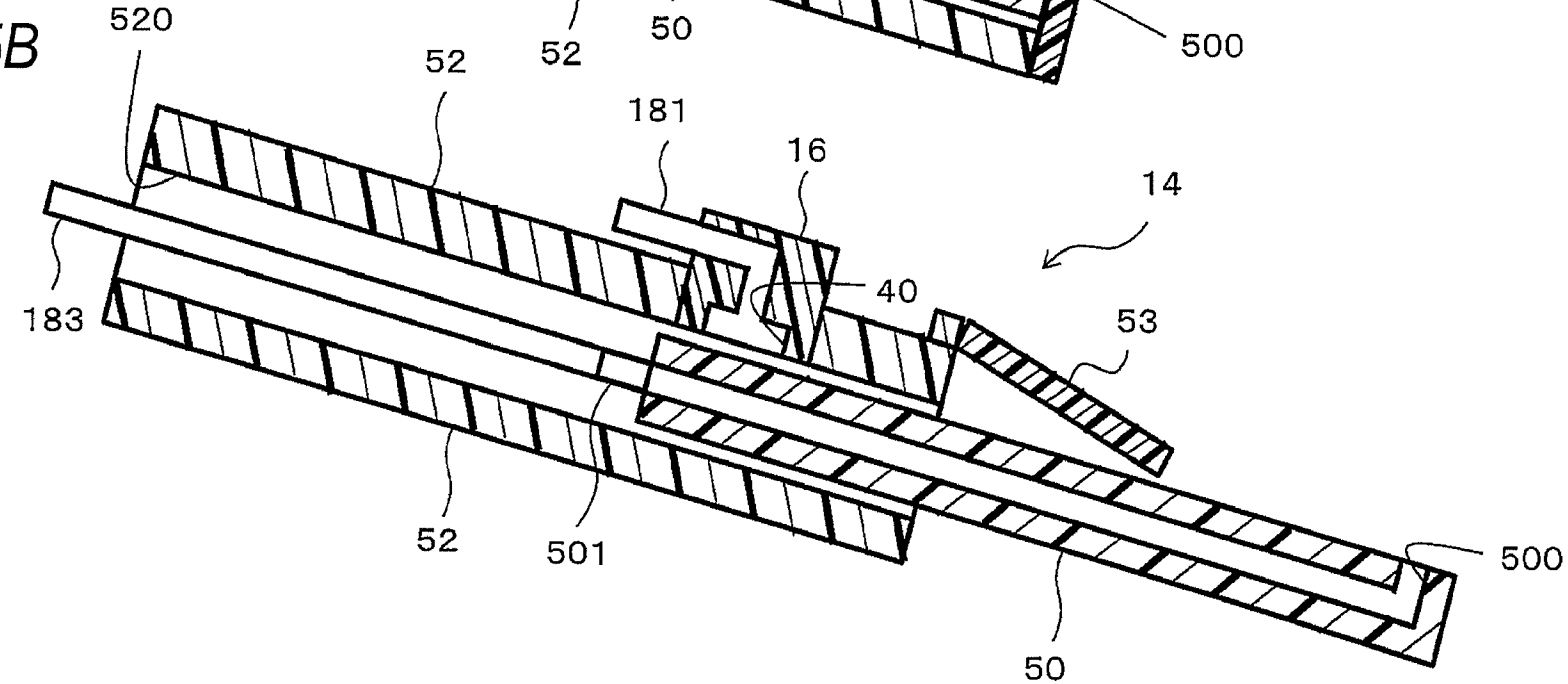

As illustrated in FIG. 2 and FIGS. 5A and 5B, the nozzle unit 14 includes the nozzle 50, which injects water, a drive unit 51, which moves the nozzle 50, a nozzle accommodating portion 52, which accommodates the nozzle 50 therein, and a shutter 53, which shields the tip end of the nozzle 50 from the outside.

As illustrated in FIG. 5A, the nozzle 50 has a columnar shape. The nozzle 50 includes a connecting portion 501 at one end in the longitudinal direction thereof and an injection port 500 at the other end thereof in the longitudinal direction. The connecting portion 501 is connected to the first outlet portion 250 of the switching valve 13 via the second supply flow path 183. The connecting portion 501 and the injection port 500 communicate with each other within the nozzle 50. Thus, the water introduced from the connecting portion 501 is injected from the injection port 500. Therefore, the nozzle 50 washes a local region of the human body by injecting, from the injection port 500, the water supplied from the supply source 10.

As illustrated in FIG. 2, the drive unit 51 is electrically connected to the controller 17. The drive unit 51 may include, for example, a motor and a conversion mechanism, which converts rotation of the motor into linear movement of the nozzle 50. Then, the drive unit 51 moves the nozzle 50 back and forth between a "protruding position", which is the position at which the nozzle 50 protrudes from the toilet seat 2, and a "storage position", which is the position at which the nozzle 50 is hidden by the toilet seat 2.

As illustrated in FIG. 5A, the nozzle accommodating portion 52 has a cylindrical shape. The nozzle accommodating portion 52 may be formed of any material that is hard to transmit light such as ultraviolet rays. The material that is hard to transmit ultraviolet rays is for example, a PBT resin or a resin material which is kneaded with an ultraviolet absorbent.

The nozzle accommodating portion 52 accommodates the nozzle 50 in a space 520 therein. At this time, the nozzle 50 moves back and forth in the space 520 inside the nozzle accommodating portion 52. Then, when the nozzle 50 is at the storage position, the nozzle accommodating portion 52 shields the portion of the nozzle 50, other than the tip end of the nozzle 50, from the outside.

The shutter 53 is disposed on the tip end side of the nozzle accommodating portion 52 so as to be rotatable relative to the nozzle accommodating portion 52. The shutter 53 rotates between an exposure position at which the shutter 53 exposes an opening on the tip end side of the space 520 and a shielding position at which the shutter 53 shields the opening on the tip end side of the space 520. In addition, the shutter 53 may be biased from the exposure position toward the shielding position by a biasing member such as a spring.

Therefore, when the nozzle 50 is at the storage position, the shutter 53 is located at the shielding position, thereby shielding the tip end of the nozzle 50 from the outside of the space. In addition, when the nozzle 50 moves from the storage position to the protruding position, the shutter 53 is pushed by the tip end of the nozzle 50, thereby being located at the exposure position. Therefore, the shutter 53 does not obstruct the injection of water from the nozzle 50.

Figure 6:
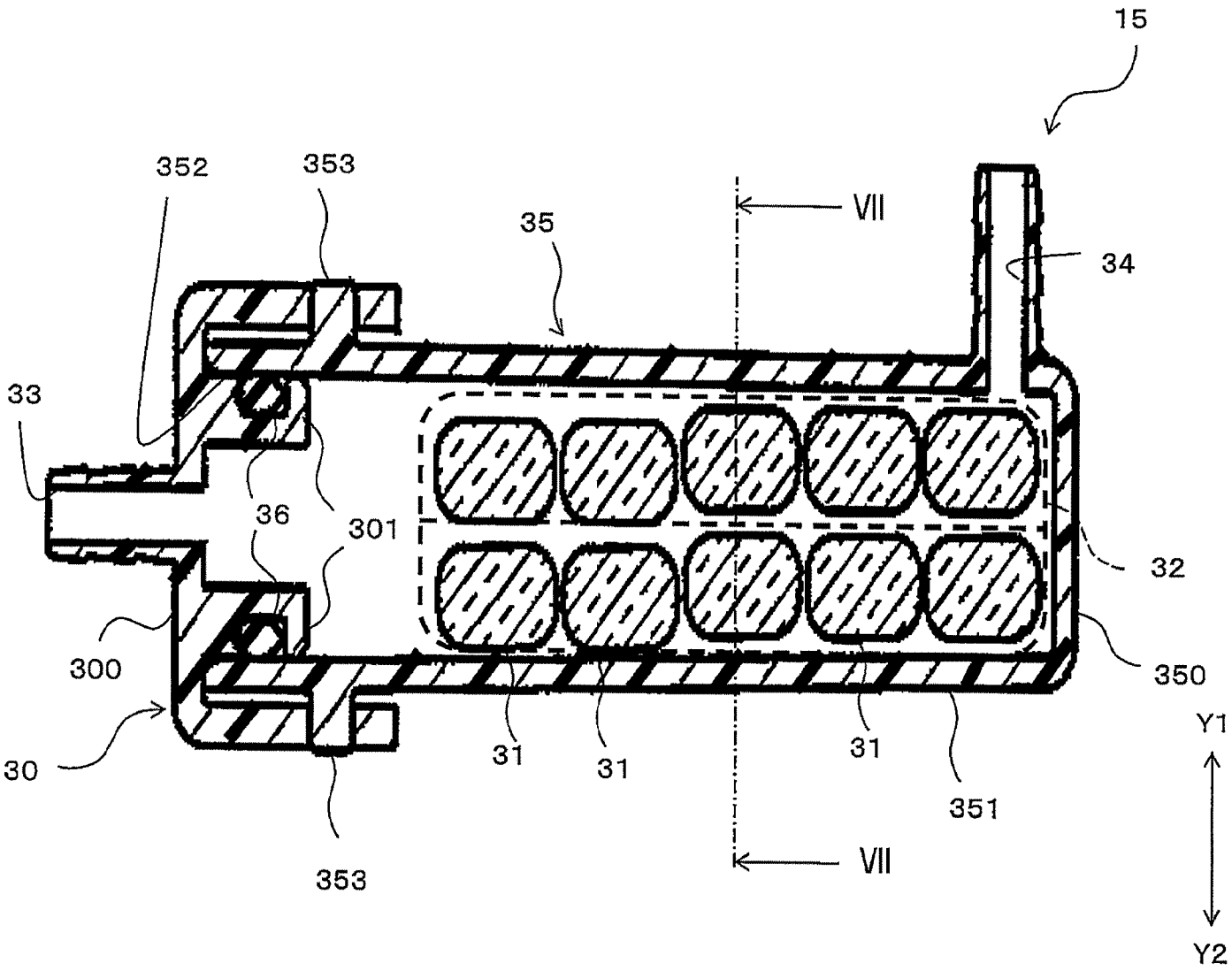
FIG. 6 is a cross-sectional view of a tank viewed from a lateral side.

As illustrated in FIG. 6, the tank 15 includes a tank body 35, a cap 30, and a seal ring 36. The tank body 35 includes a substantially cylindrical peripheral wall 351 and a bottom wall 350, which closes one end side of the peripheral wall 351 in the axial direction. Thus, an opening 352 is formed in the other end side of the peripheral wall 351 in the axial direction. In addition, an outlet 34, through which water is discharged from the tank 15, is formed in the peripheral wall 351.

The cap 30 includes a covering portion 300, which closes the opening 352 in the tank body 35, and an insertion portion 301, which is inserted into the opening 352 in the tank body 35. An inlet port 33 for introduction of water into the tank 15 is formed in the covering portion 300.

In this way, the tank 15 is configured by closing the opening 352 in the tank body 35 with the cap 30 in a state where the sterilizing agent 31 is accommodated in the tank body 35. In addition, leakage of water from the gap between the tank body 35 and the cap 30 is suppressed by interposing the seal ring 36 between the opening 352 in the tank body 35 and the insertion portion 301 of the cap 30. In addition, the tank body 35 may include a cap engagement portion 353, which is engaged with the cap 30 in a state where the cap 30 is mounted on the tank body 35. According to this, the cap 30 is suppressed form being inadvertently removed.

In addition, as illustrated in FIG. 6, the tank 15 is disposed such that the inlet port 33 is open in the horizontal direction and the outlet port 34 is open in the vertically upward direction Y1. In addition, the up-and-down direction in FIG. 6 indicates the vertical direction.

The sterilizing agent 31 is formed of a gradually soluble glass solid solution such as phosphate-based glass (or boric-acid-based glass) in which a sterilizing metal element (e.g., silver) is uniformly included. The sterilizing agent 31 is dissolved in water, thereby enhancing the sterilizing effect of water.

Figure 7:
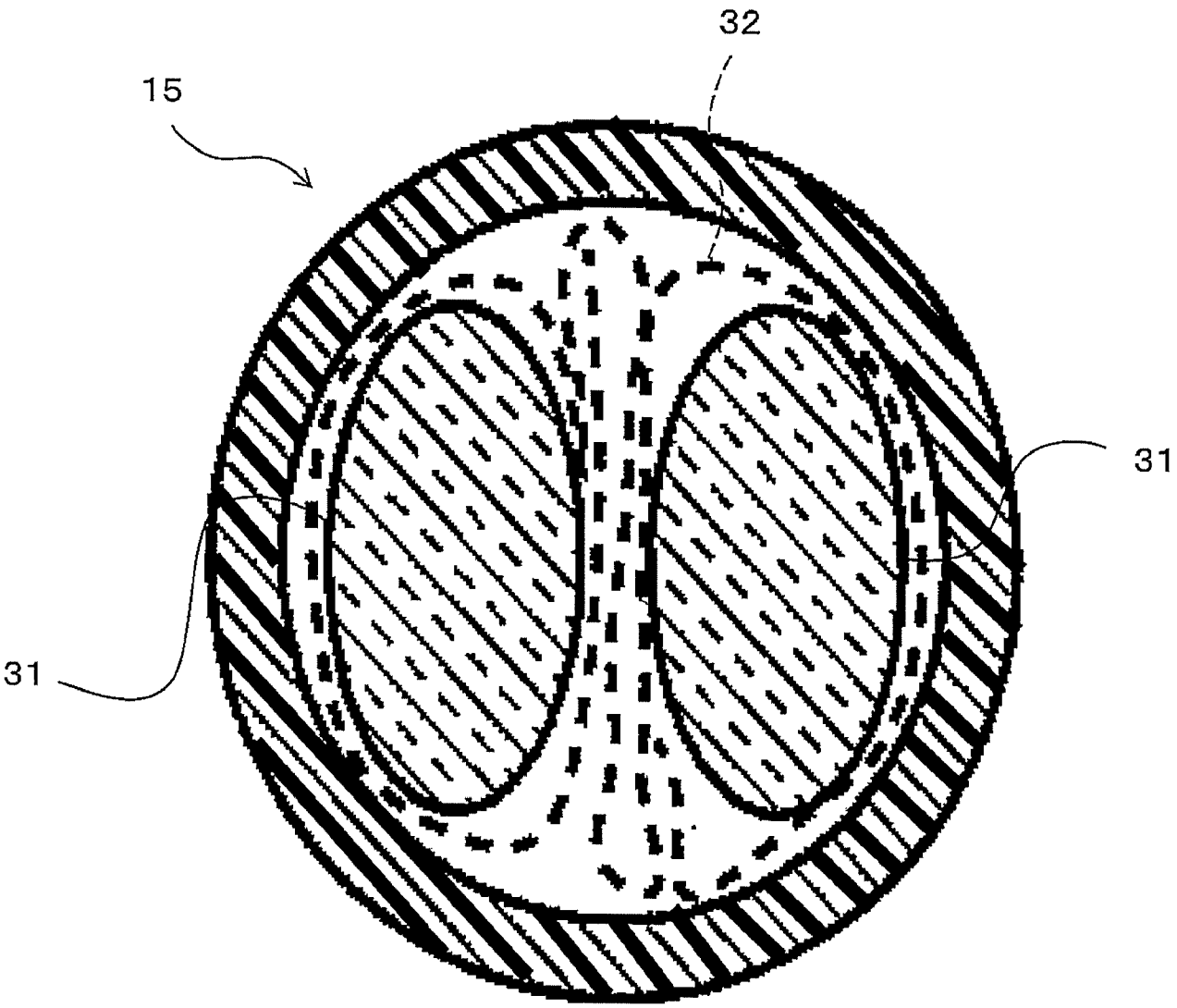
FIG. 7 is a cross-sectional view of a tank taken along arrow VII-VII of FIG. 6.

As illustrated in FIGS. 6 and 7, the sterilizing agent 31 is accommodated in the tank 15 in a state of being accommodated in a mesh bag 32 having a mesh shape. That is, the mesh bag 32 is disposed between the sterilizing agent 31 and the tank 15 so as to enclose the sterilizing agent 31 therein.

The mesh bag 32 has a rectangular bag shape. The end portions of the mesh bag 32 on the four sides are closed in a state where the sterilizing agent 31 is introduced into the mesh bag 32. The mesh bag 32 is formed of, for example, a resin material such as polyester. In addition, the mesh bag 32 may have elasticity so as to exert a force by which the mesh bag 32 restores the original shape thereof when bent.

The size of the mesh of the mesh bag 32 is set to allow water and air to pass (penetrate) therethrough. For example, the mesh of the mesh bag 32 may have a wire diameter of about 50 μm and an opening degree of about 300 μm. In this respect, the opening area of the mesh of the mesh bag 32 may be smaller than the opening area of the outlet port 34.

Figure 8A:
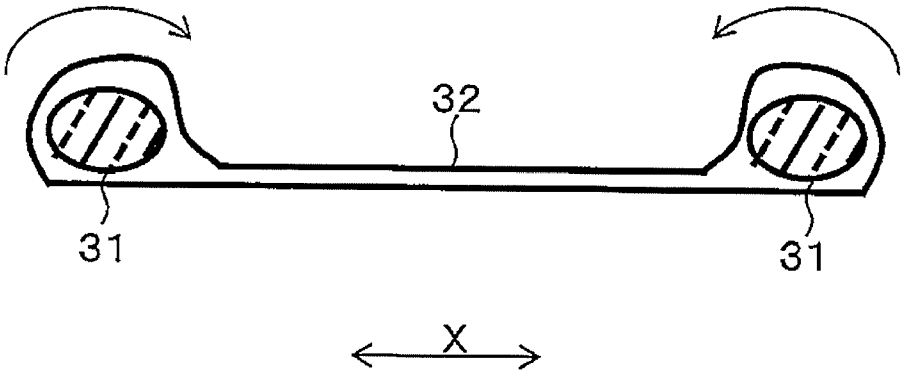
FIGS. 8A to 8C are schematic views illustrating how a mesh bag encloses a sterilizing agent therein.

As illustrated in FIG. 8A, the sterilizing agent 31 is disposed on a pair of opposite end portions of the mesh bag 32 inside the mesh bag 32. In the following description, the direction of the pair of opposite end portions of the mesh bag 32 on which the sterilizing agent 31 is disposed will be also referred to as a "width direction X".

Figure 8B:
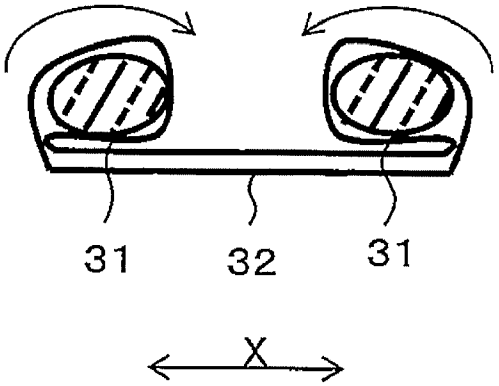
Figure 8C:
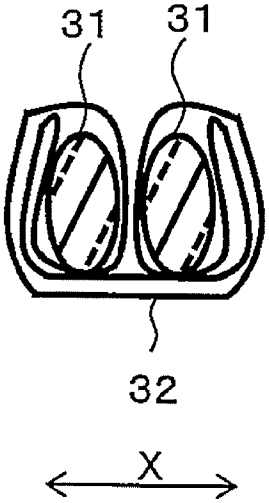

Then, as illustrated in FIG. 8B, the mesh bag 32 is wound around the sterilizing agent 31 toward the center of the mesh bag 32 in the width direction X. Thus, as illustrated in FIG. 8C, the mesh bag 32 is in a folded overlap state around the sterilizing agent 31. The mesh bag 32 is disposed in the tank 15 in this state.

At this time, since the mesh bag 32 has elasticity, a force by which the mesh bag 32 returns from the folded overlap state to the original state thereof is exerted in the tank 15. Thus, the mesh bag 32 presses the sterilizing agent 31 so as to suppress the movement of the sterilizing agent 31.

In addition, when the sterilizing agent 31 is reduced in size due to the use thereof, the mesh bag 32 is deformed by the force by which the mesh bag returns from the folded overlap state to the original state thereof. Thus, the mesh bag 32 may remain in the state of being in contact with the sterilizing agent 31. Therefore, even when the sterilizing agent 31 is reduced in size due to the use thereof, the mesh bag 32 may continuously suppress the movement of the sterilizing agent 31.

As illustrated in FIG. 5A, the nozzle washing unit 16 is provided in the upper portion of the nozzle accommodating portion 52. Specifically, the nozzle washing unit 16 is provided so as to supply the supplied water to the space 520 of the nozzle accommodating portion 52.

The nozzle washing unit 16 has a jetting port 40 from which water is ejected to the nozzle 50. The jetting port 40 faces the nozzle 50 in a state where the nozzle 50 of the nozzle unit 14 is moved backward to the storage position. Therefore, in a state where the nozzle 50 is moved backward to the storage position, the nozzle washing unit 16 washes the nozzle 50 by ejecting the water supplied from the tank 15 from the jetting port 40.

The controller 17 is configured into a well-known microcomputer including, for example, a CPU, a RAM, and a ROM. The controller 17 controls driving of the main valve 11, the switching valve 13, and the drive unit 51 of the nozzle unit 14 by executing the program read from the ROM by the CPU.

Next, the operation of the sanitary washing device 1 will be described with reference to FIG. 2.

First, when the user is not using the sanitary washing device 1, the main valve 11 is in a closed state. In addition, the switching valve 13 is in a state where the inlet portion 24 communicates with none of the first outlet portion 250 and the second outlet portion 251.

Under such a circumstance, when the sanitary washing device 1 washes a local region of the human body, the drive unit 51 of the nozzle unit 14 is driven to move the nozzle 50 to the protruding position. Once the nozzle 50 has been moved to the protruding position, the main valve 11 is switched to the opened state. Thus, water is supplied from the supply source 10 to the vacuum breaker 12. Then, in the vacuum breaker 12, the valve body 23 is pushed up by the water supplied from the supply source 10. Thus, the supply source 10 and the switching valve 13 communicate with each other.

At this time, since the switching valve 13 is in a state of connecting the first supply flow path 182 and the second supply flow path 183, the water supplied from the supply source 10 is supplied to the nozzle 50 of the nozzle unit 14. Therefore, the nozzle 50 injects the supplied water from the injection port 500 to a local region of the human body, thereby washing the local region.

When the local washing is completed, the main valve 11 is switched to the closed state. Thus, since the supply of water from the supply source 10 to the vacuum breaker 12 stops, the valve body 23 is lowered by gravity. Therefore, the water remaining in the supply flow path 180 between the vacuum breaker 12 and the nozzle 50 is discharged from the nozzle 50.

Thereafter, the switching valve 13 is switched to a state where the inlet portion 24 communicates with none of the first outlet portion 250 and the second outlet portion 251. Then, the drive unit 51 of the nozzle unit 14 is driven to move the nozzle 50 backward to the storage position.

Subsequently, the sanitary washing device 1 performs washing of the nozzle 50. First, the main valve 11 is switched to the opened state. Thus, the supply source 10 and the switching valve 13 communicate with each other. Thereafter, the switching valve 13 is switched to a state of connecting the first supply flow path 182 and the branch flow path 181.

At this time, in the embodiment disclosed here, since the inlet port 33 and the outlet port 34 of the tank 15 are disposed in different directions, the water stream in the tank 15 is not a linear water stream from the inlet port 33 to the outlet port 34, but easily becomes a water stream circulating in the tank 15. Thus, a water stream by which the water introduced into the tank 15 is stirred is generated inside the tank 15.

In addition, since the water introduced into the tank 15 passes through the mesh bag 32, the water becomes a water stream, which avoids the mesh bag 32. Thus, a water stream by which the introduced water is stirred in the tank 15 is generated. At this time, since the inside of the tank 15 is filled with the water in which the sterilizing agent 31 is dissolved, the water introduced into the tank 15 and the water in which the sterilizing agent 31 is dissolved are mixed in the tank 15. Thus, the water in which the sterilizing agent 31 is dissolved is diluted with the water introduced into tank 15 to thereby be supplied to the nozzle washing unit 16. Therefore, it is possible to suppress the water, in which the sterilizing agent 31 is dissolved, within the tank 15 from being discharged from the outlet port 34 prematurely.

In addition, the mesh bag 32 is interposed between the sterilizing agent 31 and the tank body 35 and suppresses the sterilizing agent 31 from directly coming into contact with the tank body 35. Therefore, the mesh bug 32 suppresses the sterilizing agent 31 from moving around inside the tank body 35. In this respect, the mesh bag 32 also functions as a "buffer".

In addition, the nozzle washing unit 16 ejects the water supplied from the tank 15 from the jetting port 40 to the nozzle 50 of the nozzle unit 14. In this way, the nozzle 50 is washed with water having a sterilizing component after the local washing.

Thereafter, the main valve 11 is switched to the closed state. Thus, since the supply of water from the supply source 10 to the vacuum breaker 12 stops, the valve body 23 is lowered by gravity. Therefore, the outlet flow path 21 is connected to the atmosphere communication port 22 and is not connected to the inlet flow path 20. Thus, the water remaining inside the first supply flow path 182 and the branch flow path 181 between the vacuum breaker 12 and the nozzle washing unit 16 and inside the tank 15 is discharged from the jetting port 40 of the nozzle washing unit 16.

At this time, since the outlet port 34 is provided in the vertically upward direction Y1 than the inner bottom surface of the tank 15, it is possible to suppress the water inside the tank 15 from being wholly discharged by gravity or the water stream. Therefore, when the water is drained by the action of the vacuum breaker 12, the water is likely to remain inside the tank 15.

In addition, due to surface tension, a water film is formed in the mesh of the mesh bag 32, which is located in the vertically upward direction Y1 than the surface of water inside the tank 15. That is, when drained by the action of the vacuum breaker 12, the water is likely to remain in the mesh of the mesh bag 32.

On the other hand, since the inlet port 33 is located in the downward vertical direction Y2 below the outlet port 34, the water introduced from the inlet port 33 flows toward the outlet port 34 against gravity. Therefore, the water introduced from the inlet port 33 is less likely to be linearly directed to the outlet port 34. Due to this, the water stream by which the water is stirred is generated inside the tank 15.

Then, when the discharge of water in the supply flow path 180 is completed, the switching valve 13 is switched to a state where the inlet portion 24 communicates with none of the first outlet portion 250 and the second outlet portion 251.

According to the above-described embodiment, the following effects may be obtained.

(1) Since the outlet port 34 is provided in the vertically upward direction Y1 compared to the inner bottom surface of the tank 15, water is likely to remain inside the tank 15. That is, even when water is discharged from a flow path between the vacuum breaker 12 and the nozzle washing unit 16 by the action of the vacuum breaker 12, the water is likely to remain within the tank 15.

As a result, when the sanitary washing device 1 is not in use, the sterilizing agent 31 may be dissolved in the water remaining in the tank 15. Therefore, it is possible to enhance the sterilizing effect of water supplied to the nozzle washing unit 16 at the next nozzle washing. Thus, it is possible to enhance the washing effect of the nozzle washing unit 16, which washes the nozzle 50.

(2) Since the inlet port 33 is located in the vertically downward direction Y2 compared to the outlet port 34, the water introduced from the inlet port 33 is less likely to be linearly directed toward the outlet port 34 under the influence of gravity. Therefore, a water stream by which water is stirred may be easily generated within the tank 15. Thus, it is possible to suppress water having a high concentration of a sterilizing component from being discharged prematurely.

(3) Since the inlet port 33 and the outlet port 34 are open in different directions, the water introduced from the inlet port 33 is less likely to be linearly directed to the outlet port. Therefore, the water stream by which water is stirred may be easily generated inside the tank 15. Thus, it is possible to further suppress water having a high concentration of sterilizing component from being discharged prematurely.

(4) Since the mesh bag 32 encloses the sterilizing agent 31 therein, it is possible to suppress the sterilizing agent 31 from directly colliding with the inner wall of the tank 15 when water is supplied into the tank 15. Thereby, the generation of abnormal noise by the sterilizing agent 31 may be suppressed.

(5) In a case where the water supplied from the supply source 10 is tap water, when the concentration of the sterilizing agent 31 dissolved in the water, which is used for nozzle washing, becomes high, chloride ions contained in tap water and silver ions contained in water, which is used for nozzle washing, are combined to easily form silver chloride. Then, upon being exposed to light, silver chloride is reduced to silver by an auto-oxidation-reduction reaction, and thus a region to which silver chloride adheres, is blackened.

Therefore, in the case where the concentration of the sterilizing agent 31 dissolved in the water, which is jetted from the nozzle washing unit 16 to the nozzle 50, is high, when the nozzle 50 is exposed to light in the state where the water adheres thereto, the nozzle 50 may be blackened. In this respect, while the nozzle 50 is at the storage position, the nozzle 50 of the embodiment disclosed here is shielded from the outside by the nozzle accommodating portion 52 and the shutter 54, which are formed of a material that does not transmit light. As a result, blackening of the nozzle 50 may be suppressed.

Hereinafter, another embodiment of the above-described embodiment will be described.

In the tank 15, the inlet port 33 and the outlet port 34 may be open in the same direction. For example, one of the inlet port 33 and the outlet port 34 may be provided in the cap 30, and the other one may be provided in the bottom wall 350. In addition, both the inlet port 33 and the outlet port 34 may be provided in the cap 30, or may be provided in the bottom wall 350.

The outlet port 34 of the tank 15 may be disposed at the same height as the inlet port 33 or may be provided in the vertically downward direction Y2 compared to the inlet port 33 when the outlet port 34 is disposed in the vertically upward direction Y1 compared to the inner bottom surface. Thereby, the water introduced from the inlet port 33 may be smoothly supplied to the nozzle washing unit 16.

The sterilizing agent 31 may not be accommodated in the mesh bag 32, but may be disposed in the tank 15. For example, the sterilizing agent 31 may be disposed directly inside the tank 15.

In the case of performing local washing, before performing the local washing with the nozzle 50, the water may be jetted from the nozzle 50 at the storage position of the nozzle 50. In this case, the water, in which the sterilizing agent 31 attached to the nozzle 50 was dissolved at the previous local washing, is washed away from the nozzle 50 at the current local washing.

On the upstream side of the tank 15 in the branch flow path 181, a three-way valve may be provided to change the supply destination of the water supplied from the first supply flow path 182 to the branch flow path 181. In this case, the sanitary washing device 1 may include an injection mechanism, which suppresses dirt from adhering to a toilet bowl by injecting water to the toilet bowl. According to this, the three-way valve may be switched to any one of a state of supplying the water supplied from the first supply flow path 182 to the tank 15 and a state of supplying the water to the injection mechanism.

A sanitary washing device includes: a nozzle that injects a liquid so as to wash a local region of a human body; a nozzle washing unit that washes the nozzle with the liquid; a supply flow path that connects a supply source of the liquid and the nozzle; a branch flow path that connects the supply flow path and the nozzle washing unit; a vacuum breaker that is disposed in a flow path that connects the supply source and the nozzle washing unit, in the supply flow path and the branch flow path; and a tank that is disposed in the branch flow path between the vacuum breaker and the nozzle washing unit and accommodates therein a sterilizing agent, a sterilizing component of which is dissolved in the liquid passing through the tank. The vacuum breaker opens a flow path which is connected to a downstream side of the vacuum breaker to atmosphere when no liquid is introduced from a flow path which is connected to an upstream side of the vacuum breaker. In the tank, an outlet port, through which the liquid is discharged, is disposed in a vertically upward position compared to an inner bottom surface of the tank.

According to this configuration, since the outlet port is provided in a vertically upward direction compared to the inner bottom surface of the tank, the liquid is likely to remain inside the tank. That is, even when the liquid is discharged from the flow path between the vacuum breaker and the nozzle washing unit with the action of the vacuum breaker, the liquid is likely to remain inside the tank. As a result, when the sanitary washing device is not in use, it is possible to dissolve the sterilizing agent in the liquid remaining inside the tank. Therefore, it is possible to enhance the sterilizing effect of liquid, which is supplied to the nozzle washing unit upon next nozzle washing. Thus, it is possible to enhance the washing effect of the nozzle washing unit, which washes the nozzle.

It is preferable that, in the tank, an inlet port, though which the liquid is introduced, is located in a vertically downward position compared to the outlet port.

When the inlet port and the outlet port are provided at the same height in the vertical direction, the liquid introduced from the inlet port is likely to be linearly directed to the outlet port. In addition, even when the inlet port is located above the outlet port in the vertical direction, the liquid introduced from the inlet port is likely to be linearly directed to the outlet port due to the influence of gravity. Therefore, the liquid having a high concentration of sterilizing component, which remains inside the tank, is likely to be easily discharged prematurely by being pushed out by the introduced liquid.

In this respect, according to the above configuration, since the inlet port is located in the vertically downward direction compared to the outlet port, it is difficult for the liquid introduced from the inlet port to be linearly directed to the outlet port due to the influence of gravity. Therefore, a water stream by which the liquid is stirred may be easily generated within the tank. Thus, it is possible to suppress the liquid having a high concentration of sterilizing component from being discharged prematurely.

It is preferable that, in the tank, the inlet port and the outlet port are open in different directions.

According to this configuration, since the inlet port and the outlet port are open in different directions, it is difficult for the liquid introduced through the inlet port to be linearly directed to the outlet port. Therefore, a water stream by which the liquid is stirred may be easily generated within the tank. Thus, it is possible to suppress the liquid having a high concentration of sterilizing component from being discharged prematurely.

It is preferable that, the sanitary washing device further includes, in the tank, a bag that has liquid permeability and encloses the sterilizing agent therein.

According to this configuration, since the bag encloses the sterilizing agent therein, when the liquid is supplied into the tank, it is possible to suppress the sterilizing agent from directly colliding with the inner wall of the tank. Thereby, it is possible to suppress the generation of abnormal noise by the sterilizing agent.

It is preferable that the bag is disposed inside the tank in a folded and overlapped state around the sterilizing agent.

It is preferable that the bag has a mesh shape.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sanitary washing device comprising:

a nozzle that injects a liquid so as to wash a local region of a human body;

a nozzle washing unit that washes the nozzle with the liquid;

a supply flow path that connects a supply source of the liquid and the nozzle;

a branch flow path that connects the supply flow path and the nozzle washing unit;

a vacuum breaker that is disposed in a flow path that connects the supply source and the nozzle washing unit, in the supply flow path and the branch flow path;

a tank that is disposed in the branch flow path between the vacuum breaker and the nozzle washing unit and accommodates therein a sterilizing agent, a sterilizing component of which is dissolved in the liquid passing through the tank; and a bag disposed in the tank, the bag has liquid permeability and encloses the sterilizing agent therein; wherein the vacuum breaker opens a flow path which is connected to a downstream side of the vacuum breaker to atmosphere when no liquid is introduced from a flow path which is connected to an upstream side of the vacuum breaker, in the tank, an outlet port, through which the liquid is discharged, is disposed in a vertically upward position compared to an inner bottom surface of the tank, and the bag is disposed inside the tank in a folded and overlapped state around the sterilizing agent.

2. The sanitary washing device according to claim 1, wherein, in the tank, an inlet port, though which the liquid is introduced, is located in a vertically downward position compared to the outlet port.

3. The sanitary washing device according to claim 2, wherein, in the tank, the inlet port and the outlet port are open in different directions.

4. The sanitary washing device according to claim 1, wherein the bag has a mesh shape.

* * * * *